US006684421B2

(12) United States Patent
De Gelis

(10) Patent No.: US 6,684,421 B2
(45) Date of Patent: Feb. 3, 2004

(54) BED FRAME CONSTITUTED BY A RIGID FRAME AND SLATS AND SUBASSEMBLY ADAPTED FOR THE PRODUCTION OF SUCH A BED FRAME

(76) Inventor: Alain De Gelis, La Croix Blanche, Chavagne (FR)

( * ) Notice: Subject to any disclaimer, the term of this patent is extended or adjusted under 35 U.S.C. 154(b) by 0 days.

(21) Appl. No.: 10/188,062

(22) Filed: Jul. 3, 2002

(65) Prior Publication Data

US 2004/0003464 A1 Jan. 8, 2004

(51) Int. Cl.[7] ..... A47C 23/00; A47C 23/06
(52) U.S. Cl. ..... 5/236.1; 5/238
(58) Field of Search ..... 5/236.1, 238, 239, 5/237, 241, 242, 243, 191

(56) References Cited

FOREIGN PATENT DOCUMENTS

| | | | | |
|---|---|---|---|---|
| EP | 0 783 856 | 9/2000 | ..... | 5/236.1 |
| FR | 2640860 | * 6/1990 | ..... | 5/236.1 |
| FR | 97 15447 | 6/1999 | ..... | 5/236.1 |
| WO | 94/16913 | 8/1994 | | |

* cited by examiner

*Primary Examiner*—Alex Grosz
(74) *Attorney, Agent, or Firm*—Young & Thompson

(57) ABSTRACT

In a slatted bed frame, the slats (1) are carried pairwise at each of their ends by a flexible support (2) comprised of an element (20) in which are inserted the two slats (1) and two symmetrical elbowed branches, constituted by two lower portions (21) and two upper portions (23) articulated to each other by a hinge (27). The lower portions (21) of the support are mounted freely in rotation on the bearings (242) fixed to the rigid frame (5) of the bed frame, each terminating in a toothed wheel portion which engages the toothed wheel portion of the other lower portion of the branch of the support. The supports (2) located at the two ends of the slats (1) of the pair of slats are secured in rotation by two transverse rods (3) connecting the lower portions (21) and providing a resilient return.

8 Claims, 3 Drawing Sheets

BED FRAME CONSTITUTED BY A RIGID FRAME AND SLATS AND SUBASSEMBLY ADAPTED FOR THE PRODUCTION OF SUCH A BED FRAME

BACKGROUND OF THE INVENTION

The present invention relates to improvement in bed frames constituted by an assembly of flexible parallel slats.

DESCRIPTION OF THE RELATED ART

In the patent EP 0 680 715, there is described such a frame in which the slats are carried pair-wise at each of their ends by a flexible support with two symmetrically elbowed branches, the lower branches of said support each terminating in a toothed wheel portion which engages on the toothed wheel portion of the other lower branch of the support, the supports located at the two ends of the slats of said pair of slats being secured in rotation by two transverse rods connecting the toothed wheel portions, these latter being subjected to resilient return means.

It develops in use that this device had the drawback that all the load applied to the frame was resisted by the resilient return means themselves fixed to the branches of the supports, which meant that all the forces were resisted by the supports and these latter failed in use.

On the other hand, it was seen that the elbowed levers broke at the bend from fatigue of the material used.

To eliminate these drawbacks, the applicant has, in his European patent EP 0 783 856 filed Jan. 8, 1997, replaced each elbowed lever with a lever in two parts articulated to each other by a hinge and embodying a system returning the flexural forces of the lower flexible slats by means of one or several crosspieces. Moreover, according to this EP 0 783 856, the number of crosspieces can be multiplied and their spacing can be varied, it being possible to adjust as desired the resilience of the system.

This device gives excellent results, but it is too cumbersome, which has kept it off the market.

In French patent 97 154 17 of Dec. 5, 1997, there is disclosed another improvement according to which a spring is disposed between the flexible slats and an abutment is carried by the rigid frame of the bed base such that the forces are transmitted to said rigid frame.

SUMMARY OF THE INVENTION

The present invention relates to improvements to the device described in French patent 97 154 17.

A first improvement consists in the abutment carried by the rigid frame against which the spring bears, is carried by the piece which bears the bearings on which the two articulated levers pivot, this piece being disposed above the rigid frame.

The bed frame according to the invention is also notable in that:

- said carrying member is constituted by two walls disposed at a right angle relative to each other, the first wall carrying the bearings and the second wall, perpendicular to the first wall, serving as the bearing abutment for the spring,
- said second wall is disposed along one edge of the first wall such that said carrying member rests on the top of the rigid frame with said first wall along the internal vertical surface of the rigid bed frame and said second wall against the upper horizontal surface of said frame.

The second improvement consists in that the spring bears on the support against the element which carries the two slats by means of a disassembleable abutment.

To this end:

- said disassembleable abutment comprises a head, a cylindrical skirt in which is inserted the spring, and two lugs,
- said disassembleable abutment is mounted on the element which carries the two slats, the head of the abutment bears against the upper surface of the element, the cylindrical skirt extends into an opening of said element and the lugs bear against the lower surface of the element,
- the lugs of the disassembleable abutment and the opening of the element carrying the slats, have elongated cross-sections which are similar and which do not have symmetry of revolution.

The invention also concerns a subassembly adapted for the production of a bed frame, characterized in that it consists in:

- two slats
- two supports, comprised by an element into which are inserted the two slats and two symmetrical elbowed branches, constituted by two lower portions and two upper portions articulated to each other by a hinge, the lower portions of said support being freely mounted in rotation on bearings and each terminating in a toothed wheel portion which engages with the toothed wheel portion of the other lower portion of the branch of the support,
- two transverse rods connecting the lower portions to fix together the supports located at the two ends of the slats of said pair of slats,
- two springs each disposed between one support and one abutment,
- two carrying members each supporting an abutment against which bears a spring and the bearings on which are mounted the lower portions of the branches of a support.

The invention also relates to a process for adjusting the comfort of a slatted bed frame, characterized in that said bed frame according to the invention is sold with several assemblies of springs of different characteristics and in that the user will select for each slat the spring ensuring the support which suits him best.

BRIEF DESCRIPTION OF THE DRAWINGS

The invention will be better understood from the description which follows, given by way of non-limiting example with reference to the accompanying drawings, in which.

DETAILED DESCRIPTION OF THE PREFERRED EMBODIMENTS

Figure 1:
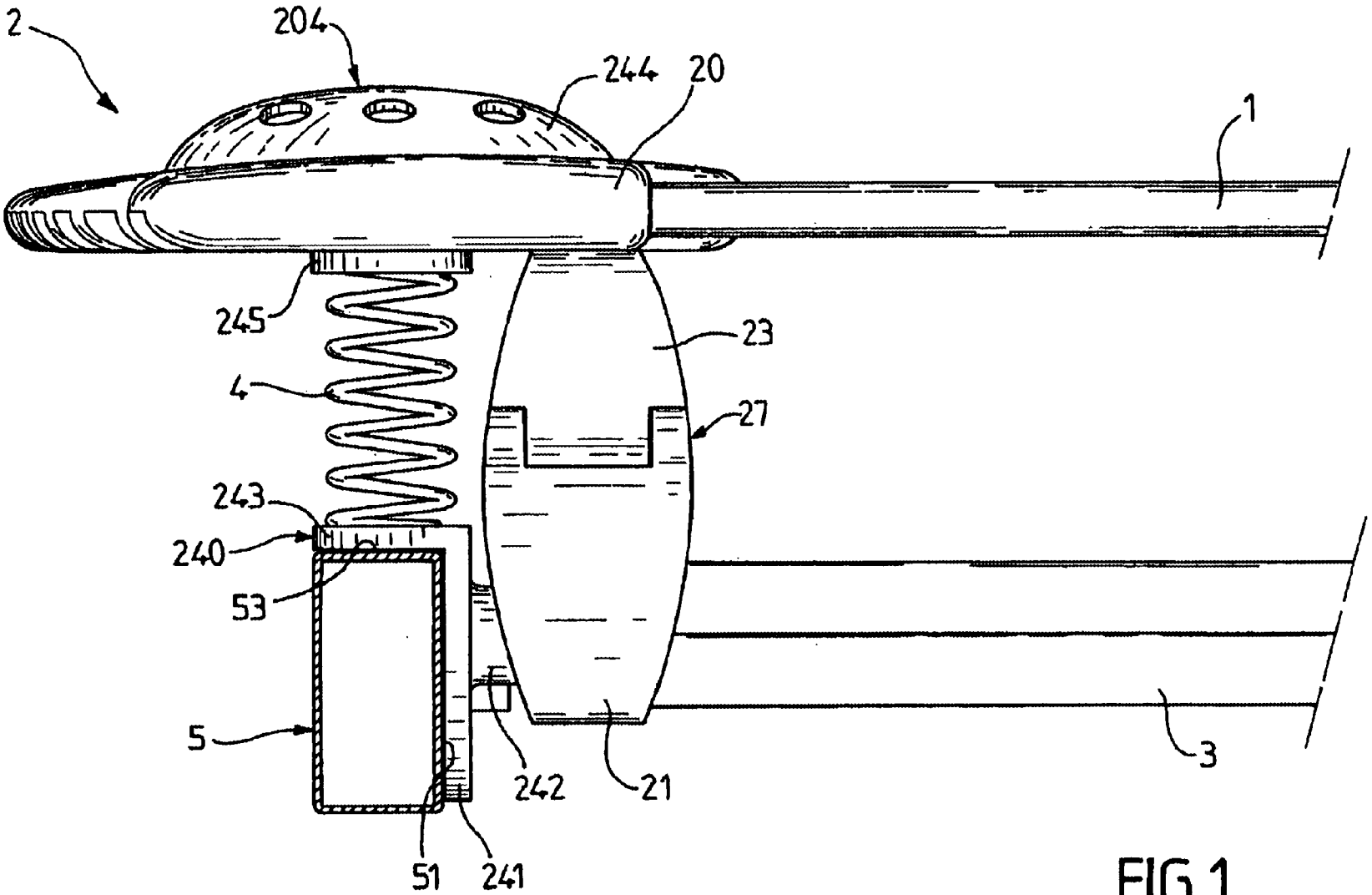
FIG. 1 is a side view showing the securement member for the ends of a pair of slats.
Figure 2:
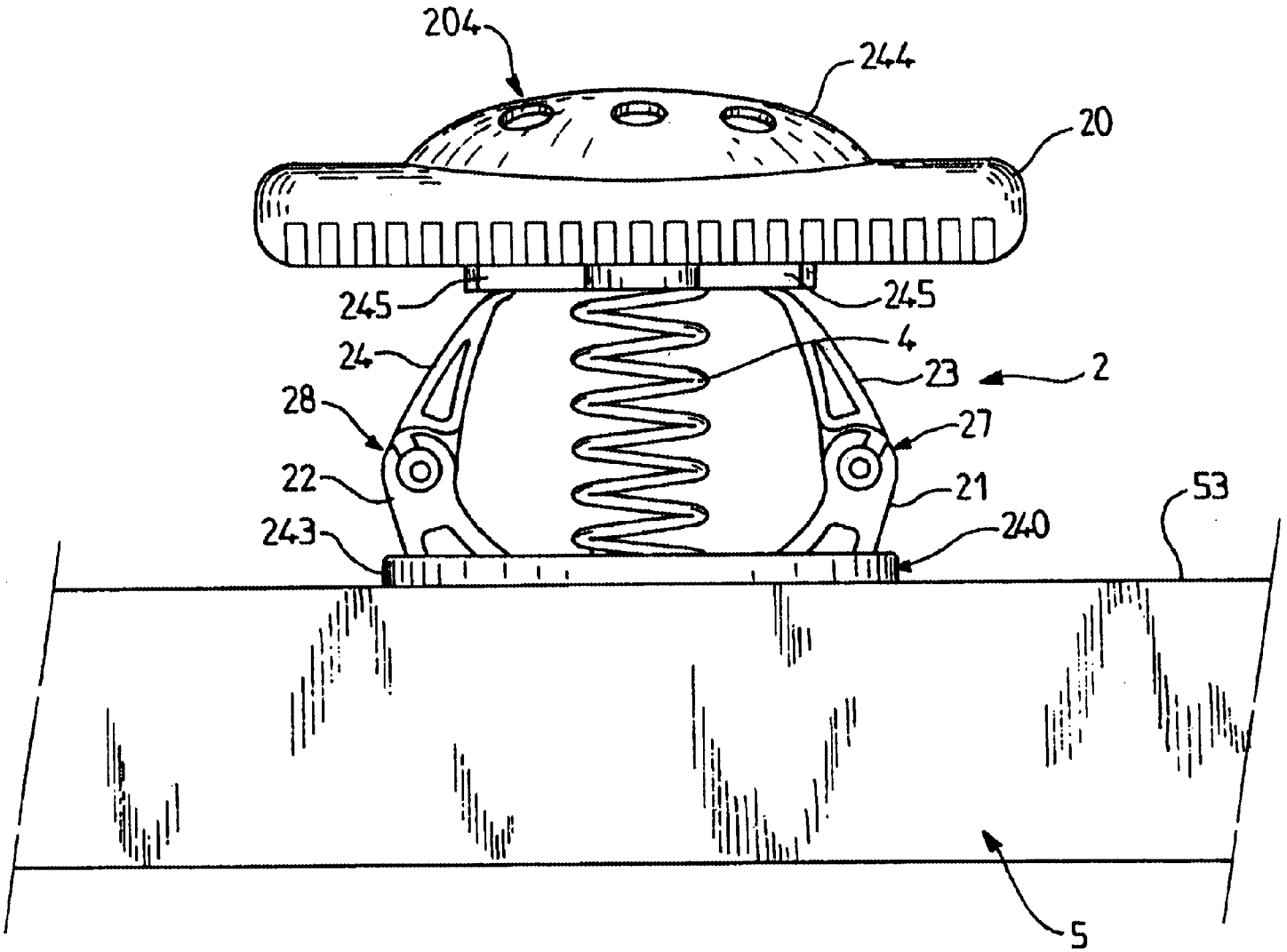
FIG. 2 is a front view of the member of FIG. 1.
Figure 3:
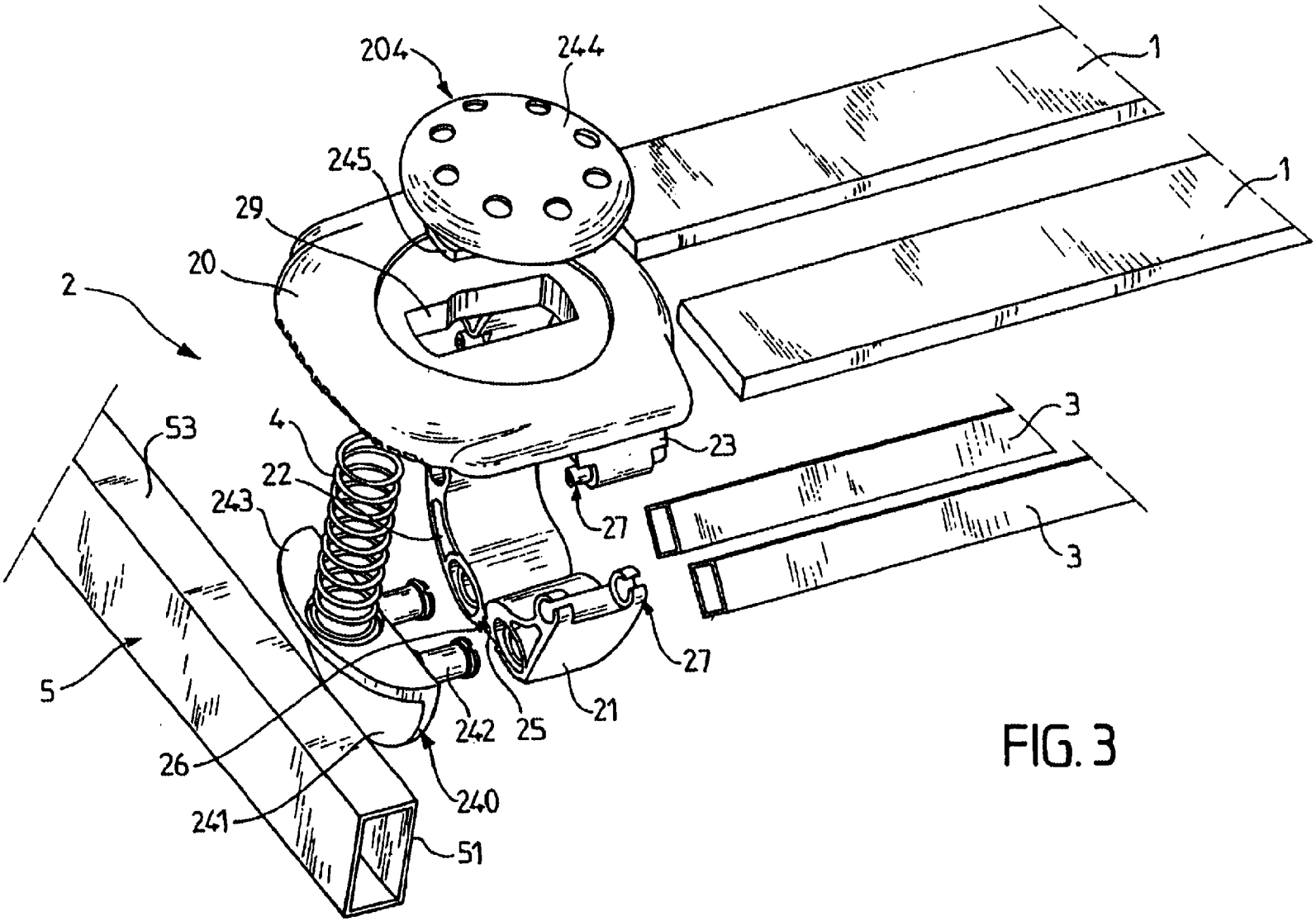
FIG. 3 is an exploded perspective view of the member of FIG. 1.

In a manner known per se, the slatted bed frame is constituted by a rigid frame 5 on which are mounted subassemblies constituted by two slats connected at each of their ends by flexible supports. So as to simplify the drawings, only one of the ends of such a subassembly is shown.

As can be seen in the drawings, the slats 1 are carried pair-wise by a flexible support 2 comprising: an element 20 into which are inserted the ends of the slats 1; as well as two symmetrical elbowed branches.

Each elbowed branch is constituted by two portions 21–23, 22–24 articulated to each other by a hinge 27, 28.

The lower portions 21, 22 of the branches of said support 2 each terminate in a toothed wheel portion 25, 26 which engages with the toothed wheel portion 26, 25 of the other lower pair 22, 21. Said lower portions 21, 22 of the support branches 2 are movably mounted in rotation on bearings fixed on the rigid bed frame, either directly, or indirectly by the use of an intermediate piece carrying said bearings.

The lower portions 21, 22 of the supports 2 located at the two ends of the slats 1 of the pair of slats, are secured together in rotation by two transverse rods 3 connecting the toothed wheel portions 25, 26. Said transverse rods 3 constitute torsion bars which on the one hand transmit rotational movement of the two supports 2 to the support 2 carrying the other end of the slats 1, but also by resilient return means said supports toward their rest position.

In a manner also known per se, a spring 4 is disposed between the element 20 into which are inserted the slats 1 and an abutment carried by the rigid frame 5 of the bed frame such that all the forces will be transmitted to said rigid frame 5.

According to the invention, a first improvement is provided to the known slatted ed frames by arranging a carrying member 240 which on the one hand supports the bearings 242 on which are mounted the lower portions 21, 22 of the elbowed branches of the support 2, and on the other hand serves as an abutment for the spring 4.

This carrying member 240 is adapted to be positioned on the rigid frame 5 of the bed frame as shown in the drawings. It is constituted by two walls 241, 243 disposed at right angles to each other. The first wall 241 carries the bearings 242 on which are mounted the lower portions 21, 22 of the support. The second wall 243, perpendicular to the first wall 241, serves as a bearing abutment for the spring 4. In the example shown in the drawings, said second wall 243 is disposed along one edge of the first wall 241.

This embodiment permits positioning the first wall 241 along the vertical internal surface 51 of the rigid frame 5 of the bed frame and the second wall 243 against the other horizontal surface 53 of said frame 5. As a modification, said second wall 243 can extend perpendicular to said first wall 241 from any point of the latter, for example near the bearings 242. This modified embodiment however renders the assembly of the bed frame less easy, because it is necessary to ensure folding of the carrying member 240 along the internal vertical surface 51 of the rigid frame 5. Preferably, the carrying member 240 as shown in the drawings rests on the rigid frame 5 and thus need not be fixed to said frame.

The use of a bearing abutment 243 for the spring 4 forming a portion of the bearing member 240, permits providing subassemblies constituted by two slats 1, two supports 2, two transverse rods 3, two springs 4 and two carrying members 240 which can be handled, stored . . . and are thus very easy to use to construct a new bed frame or to repair a used bed frame by replacing the used pair or pairs of slats with new subassemblies, because it suffices to position the carrying members 240 against the rigid frame 5 and to secure them.

The second improvement provided by the present invention relates to the fact that the spring 4 bears against at least one disassembleable abutment 204 on the element 20 into which are inserted the two slats.

Said disassembleable abutment 204 comprises a head 244, a cylindrical skirt, not shown in the drawings, in which is introduced the end of the spring 4, and two lugs 245.

When the disassembleable abutment 204 is mounted on the support 2, the head 244 bears against the upper surface of the element 20, the cylindrical skirt extends into an opening 29 in said element 20 and the lugs 245 bear against the lower surface of the element 20.

The lugs 245 of the disassembleable abutment 204 and the opening 29 of the element 20 carrying the slats 1 have elongated cross-sections which are similar and that do not have symmetry of revolution.

During mounting of the disassembleable abutment 204, the cylindrical skirt carrying the lugs 245 is inserted through the opening 29 of the element 20, then when the cylindrical skirt of said abutment extends through said opening 29, the abutment 204 is driven in rotation for about 90° such that the lugs 245 will be disposed perpendicular to the long axis of the opening 29. In this position, the disassembleable abutment 204 is secured to the element 20 bearing the slats 1.

This arrangement according to the invention, in which the abutment 204 can be assembled and disassembled by simple movement of rotation applied to the head 244, preferably permits being able to remove and replace the springs 4. It is thus possible to adjust the characteristics of springs 4 to the needs of the user or to replace worn springs in the case of a very rapid maintenance operation to be performed and not requiring any particular tool.

Preferably, the user can himself withdraw said abutments to replace the springs. As a result, the bed frame can be sold with several assemblies, for example three assemblies, of springs of different characteristics distinguishable for example by their color, which permits the user to try several configurations of the bed frame and to select for each slat the spring ensuring the support which suits him best.

What is claimed is:

1. Bed frame constituted by a rigid frame (5) and slats (1) in which the slats (1) are carried pair-wise at each of their ends by a flexible support (2) comprised by an element (20) into which are inserted the two slats (1) and two symmetrical elbowed branches, constituted by two lower portions (21, 22) and two upper portions (23, 24) articulated to each other by a hinge (27, 28), the lower portions (21, 22) of said support being mounted freely in rotation on bearings (242) secured to the rigid frame (5) of the bed frame and each terminating in a toothed wheel portion (25, 26) which engages the toothed wheel portion of the other lower portion of the branch of the support, the supports (2) located at the two ends of the slats (1) of said pair of slats being secured together in rotation by two transverse rods (3) connecting the lower portions (21, 22) and constituting a resilient return means, a spring being disposed between each support (2) and an abutment carried by the rigid frame (5) of the bed frame, characterized in that each abutment (243) carried by the rigid frame (5) against which the spring bears (4) is carried by a carrying member (240) which supports the bearings (242) on which are mounted the lower portions (21, 22) of the support branches (2).

2. Bed frame according to claim 1, characterized in that said carrying member (240) is constituted by two walls (241, 243) disposed at a right angle to each other, the first wall (241) carrying the bearings (242) and the second wall (243), perpendicular to the first wall (241), serving as a bearing abutment for the spring (4).

3. Bed frame according to claim 2, characterized in that said second wall (243) is disposed along one edge of the first wall (241) such that said carrying member (240) rests on the top of the rigid frame with said first wall (241) along the vertical internal surface (51) of the rigid frame (5) of the bed frame and said second wall (243) against the upper horizontal surface (53) of said frame (5).

4. Bed frame according to claim 1, characterized in that the spring (4) bears on the support (2) against a disassembleable abutment (204) of the element (20) into which are inserted the two slats (1).

5. Bed frame according to claim 4, characterized in that said disassembleable abutment (204) comprises a head (244), a cylindrical skirt into which is inserted the spring (4), and two lugs (245).

6. Bed frame according to claim 5, characterized that when the disassembleable abutment (204) is mounted on the support (2), the head (244) of the abutment (204) bears against the upper surface of the element (20), the cylindrical skirt extends into an opening (29) of said element (20) and the lugs (245) bear against the lower surface of the element (20).

7. Bed frame according to claim 6, characterized in that the lugs (245) of the disassembleable abutment (204) and the opening (29) of the element (20) carrying the slats (1) have elongated cross-sections which are similar and do not have symmetry of revolution.

8. Subassembly adapted for the production of a bed frame, characterized in that it is constituted of:

two slats (1), two supports (2), comprised by an element (20) in which are inserted the two slats (1) and two symmetrical elbowed branches, constituted by two lower portions (21, 22) and two upper portions (23, 24) articulated to each other by a hinge (27, 28), the lower portions (21, 22) of said support being mounted freely in rotation on bearings (242) and each terminating in a toothed wheel portion (25, 26) which engages with the toothed wheel portion of the other lower portion of the branch of the support, two transverse rods (3) connecting the lower portions (21, 22) to secure together the supports (2) located at the two ends of the slats (1) of said pair of salts, two springs (4) each disposed between a support (2) and an abutment (243), two carrying members (240) each supporting an abutment (243) against which bear the spring (4) and the bearings (242) on which are mounted the lower portions (21, 22) of the branches of a support (2).

* * * * *